313-414 SR
10/10/78 XR 4,119,884

United States Patent [19]

Blumenberg et al.

[11] 4,119,884

[45] Oct. 10, 1978

[54] UNITIZED ELECTRON GUN HAVING ELECTRODES WITH INTERNAL BEAM-SHIELDING TUBES

[75] Inventors: Horst H. Blumenberg, Elmwood Park; Kenneth A. Guzowski, Chicago, both of Ill.

[73] Assignee: Zenith Radio Corporation, Glenview, Ill.

[21] Appl. No.: 834,029

[22] Filed: Sep. 16, 1977

Related U.S. Application Data

[63] Continuation of Ser. No. 655,592, Feb. 5, 1976, abandoned.

[51] Int. Cl.[2] ..... H01J 29/02; H01J 29/82

[52] U.S. Cl. ..... 313/417; 313/458; 313/414

[58] Field of Search ..... 313/409, 411, 412, 414, 313/417, 458, 413, 448

[56] References Cited

U.S. PATENT DOCUMENTS

| | | | |
|---|---|---|---|
| 2,887,598 | 5/1959 | Benway | 313/412 |
| 3,771,002 | 11/1973 | Standaart | 313/414 X |
| 3,890,528 | 6/1975 | Say et al. | 313/414 |
| 3,936,692 | 2/1976 | Izumida et al. | 313/414 |
| 3,987,328 | 10/1976 | Yoshida et al. | 313/414 |

*Primary Examiner*—Robert Segal
*Attorney, Agent, or Firm*—Ralph E. Clarke, Jr.

[57] ABSTRACT

This disclosure depicts and describes unitized electron guns for color television cathode ray tubes, and is particularly addressed to an improved structural design for elongated electrodes of such guns in which undesired internal interaction between adjacent electron beam-forming fields is prevented. This sheet metal electrode design also has the advantage of lending itself to economical manufacture.

2 Claims, 10 Drawing Figures

UNITIZED ELECTRON GUN HAVING ELECTRODES WITH INTERNAL BEAM-SHIELDING TUBES

CROSS-REFERENCES TO RELATED APPLICATIONS

This is a continuation of application Ser. No. 655,592, filed Feb. 5, 1976, now abandoned. This application is related to but in no way dependent upon copending applications of common ownership herewith assigned, including: Ser. No. 494,123, filed Aug. 2, 1974; now U.S. Pat. No. 3,995,194; Ser. No. 649,630, filed Jan. 16, 1976; Ser. No. 642,049, filed Dec. 18, 1975; now U.S. Pat. No. 4,032,811 and Ser. No. 666,858, filed Mar. 15, 1976.

BACKGROUND OF THE INVENTION

This invention relates generally to improved unitized in-line and delta-configured guns for color cathode ray tubes, and is specifically addressed to an improved electrode structure for such guns that enhances picture resolution.

Unitized electron guns generate three electron beams developed by cathodic thermionic emission. The resulting beams are formed and shaped by a tandem succession of electrodes spaced along the central axis of the gun. The electrodes cause the beam to be focused on multiple phosphor groups located on the faceplate of a color cathode ray tube. A prime objective in the design of such guns is to provide small beam spot size with enhanced picture resolution. Unitized guns may be of the in-line type, or may be of triangular or "delta" configuration.

A problem arises in the design and construction of unitized guns in that the beams must travel in close proximity because of the space restriction of the narrow confines of the neck of the cathode ray tube in which the guns lie. If the beam passageways do not provide shielding, the lines of force generated in the electron lens section of the gun, which act to focus the electron beams at the proper point of convergence on the viewing screen, will interact and exert an undesired effect on the beams as they pass between and through the electrodes. Any such "crosstalk" can result in deforming the beams within the electrode structures so that the beams become elliptical at their points of landing. This ellipticity must be compensated for at the penalty of an undesired increase in spot size.

This problem of deleterious interaction of the fields is negligible in those non-unitized guns wherein each beam travels through a separate discrete tunnel formed by a series of individual "barrels" extending from the source of the beam at each cathode through to the convergence assembly at the opposite end of the gun.

A common system of electrode forming is by means of dies which can produce large quantities of identical components that meet tight tolerance requirements. In U.S. Pat. No. 3,873,897 issued to Hughes, examples of economical die-formed electrodes are shown that are deep-drawn in matching cup-like sections which are mated at annular flanges projecting from the cup faces and bonded by spot-welding. This design does not provide internal shielding, however and, the result can be undesired distortion of the beams due to interactive effect.

In U.S. Pat. No. 3,890,528, Say recites a focusing electrode structure for a tri-potential, delta-configured electron gun, or an in-line unitized gun, having offset electrode apertures for convergence wherein improved shielding of the apertures is provided by lips extending a short distance into the focusing electrode aperture for each beam. The stated objective of the Say invention is to effect improved control of the lines of force in the low beam velocity area (i.e., better focusing effects) of each discrete electron beam. The patent does not address itself to the continuous internal shielding of the beams to prevent mutual field interaction in their passage through the electrode.

In Pat. U.S. No. 24 38 234 (German), a scheme is recited wherein the beam-passing apertures in the opposing faces of cup-like electrode sections used in delta-configured or in-line guns are augmented by superimposing one or more unitized plates upon them which come together to define a very short beam-passing tube. However, the objective is to extend the axial lip structure so as to improve the symmetry of the electrical field between opposing openings. The patent does not show the use of inserts to permit the construction of an elongated electrode with a beam-passing tube all the way through.

OBJECTS OF THE INVENTION

It is a general object of this invention to provide an improved design for elongated electrodes of unitized electron guns that enhances picture resolution in color cathode ray tubes.

It is a less general object to provide an improved electrode design for unitized electron guns for color cathode ray tubes which reduces intra-electrode interference between adjacent beam-forming fields.

It is a further object to provide unitized electrode designs for color cathode ray tube electron guns having greater strength to resist physical stress.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings in which the several figures of which like reference numerals identify like elements, and in which:

DESCRIPTION OF THE PREFERRED EMBODIMENT

This invention relates to an improved electrode design for unitized electron guns that enhances picture resolution, adds mechanical strength, and is more economical to manufacture.

Unitized types of electron guns offer many advantages over other types in common use for color cathode ray tubes such as the delta-cluster gun. Advantages include the fact that the gun has fewer parts and the "unitizing" of the control grid and accelerating grid results in fewer connections and circuits.

Figure 1:
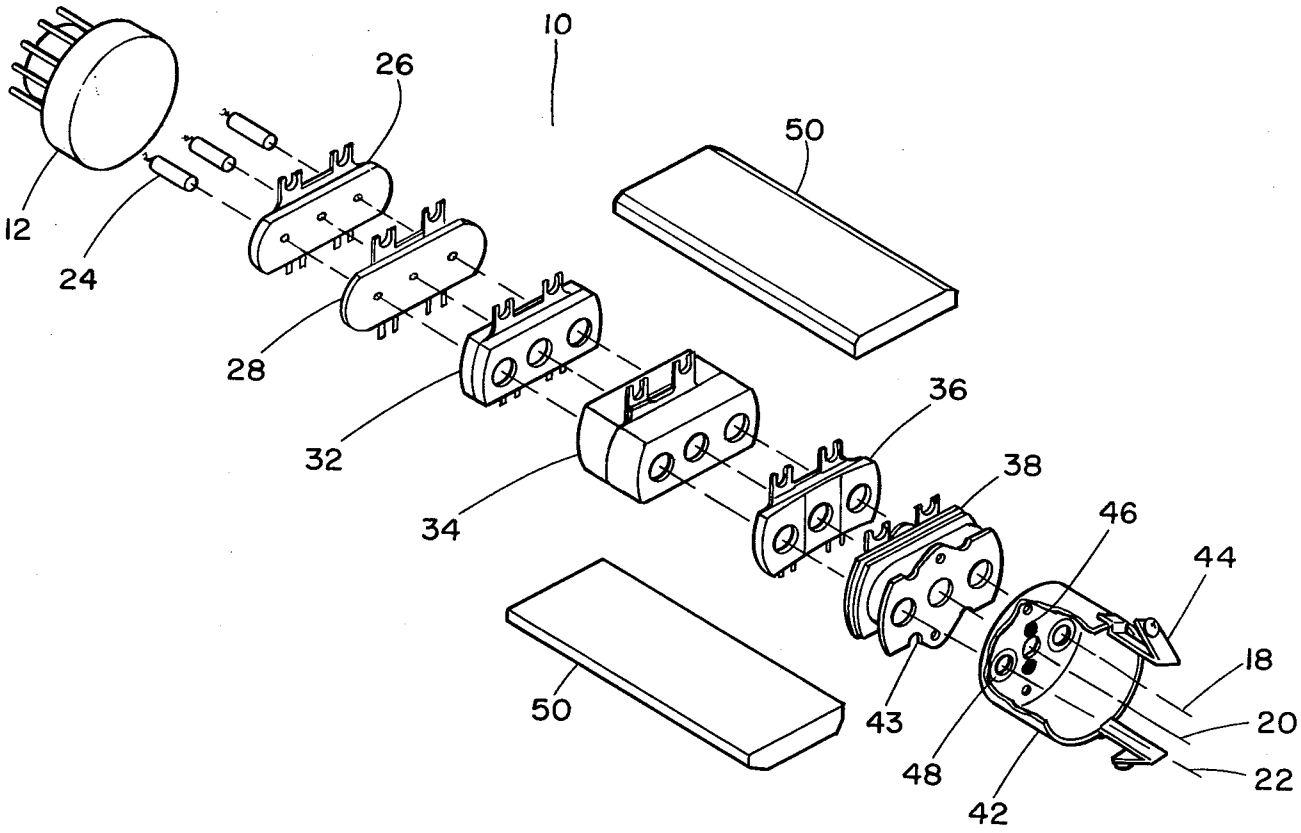
FIG. 1 is an exploded view in perspective of the major elements of a color cathode ray tube unitized in-line gun embodying the present invention.
Figure 2:
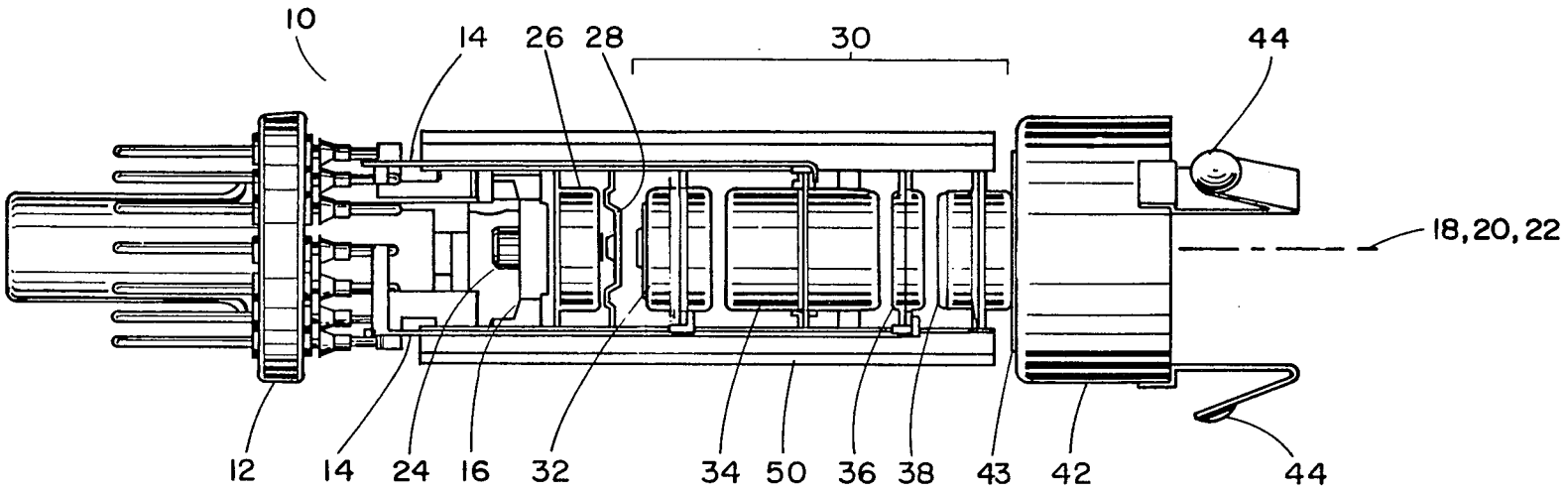
FIG. 2 is an assembled side view of the same gun shown in FIG. 1.

Whereas the invention can be embodied in electrode structures of several different types, preferred embodiments of the principles of this invention are illustrated in FIGS. 1, 2 4–10. FIG. 1 is an exploded view in perspective of a unitized electron gun for use in a color television cathode ray tube, which gun incorporates the present invention. FIG. 2 is an assembled side view of the FIG. 1 gun. As is well known in the art, the electron gun structure for a cathode ray tube is located at the base of the tube in the narrow neck region opposite the faceplate. The illustrated embodiment is of the in-line type, generating three coplanar electron beams, each of which is formed, shaped and directed to selectively energize phosphor elements located on the imaging screen in the expanded area at the opposite end of the cathode ray tube envelope.

Referring to FIGS. 1 and 2, a cathode ray tube base 12 provides a plurality of electrical leads for introducing into the glass envelope the video and blanking signals as well as certain voltages for beam forming and focusing. The operating signals and voltages are conveyed to the several electrodes and grids of gun 10 within the glass envelope by means of several internal electrical leads, two typical ones of which are shown by 14. The three electron-emitting cathodes 24 of the heater-cathode assembly 16 generate three coplanar beams of electrons 18, 20 and 22 which travel through a series of electrodes to energize the red, green and blue phosphors on the imaging surface of the television cathode ray tube through a multi-apertured color selection electrode (not shown). A unitized, disc-type accelerating grid 28 follows control grid 26 in the progression of the three electron beams from the cathodes 24 to the imaging screen.

The three beams then enter the electrostatic fields of the beam focusing lens 30, consisting of unitized electrodes 32, 34, 36 and 38 constructed according to this invention. Each electrode in lens 30 carries a predetermined voltage to establish a beam focusing field, or an "electrostatic lens" for each beam. This type of lens, also referred to as an "extended field lens", utilizes the principles of the extended field lens described and claimed in U.S. Pat. No. 3,895,253 by Schwartz et al. Each electrode 32, 34, 36 and 38 is electrically isolated from the others to establish the focusing fields of the electron lens which they comprise.

The difference in potential between adjacent focusing electrodes 32, 34, 36 and 38 establishes a series of focusing field components capable of shaping a beam of electrons flowing through the field components, according to the principles of electron optics. In the unitized, in-line gun that is the subject of this disclosure, the potentials between electrodes 32, 34, 36 and 38 may, for example, have an axial potential distribution which varies monotonically from a relatively intermediate potential at electrode 32, to a relatively low potential at electrode 34, and varies again monotonically to a relatively intermediate potential at electrode 36, to a relatively high potential at electrode 38. This axial potential distribution concept is the subject of the reference U.S. Pat. No. 3,995,194.

Further shaping, directing and focusing of the electron beam is accomplished between electrodes 36 and 38, the configuration of which constitutes two separate electron lens components for converging the outer two beams 18 and 22 inwardly to a common point of combination with central beam 20, which does not vary from a direct axial path. The convergence of beams 18 and 22 towards center beam 20 is accomplished by a slight inward bias shape of the two electrode faces of the two outer beam apertures of electrode 36, and a parallel, matching bias shape on the facing members of electrode 38. The bias-shaped electrode concept does not constitute, per se, an aspect of this invention but is described and claimed in copending application Ser. No. 666,858.

The last in the series of elements that comprise electron beam gun 10 is the convergence cup 42 that provides a mounting base for the three contact springs 44 which center the forward end of the gun in the neck of the cathode ray tube. Also, through contact with the electrically conductive coating on the inside of the neck of the tube, contact springs 44 convey high voltage through convergence cup 42 to electrode 38. Located within the cup formed by the convergence cage, and adjacent to the apertures from which the three electron beams 18, 20 and 22 emerge are magnetic enhancers 46 and shunt magnets 48. Convergence cup 42 is aligned and bonded to electrode 38 in precise registration by means of a carrier plate 43, which lies between the two elements. The carrier plate and its associated assembly method does not constitute, per se, an aspect of this invention, but is described and claimed in copending application Ser. No. 649,630.

In the unitized, in-line gun described in this disclosure, the electrodes have on each side thereof at least one pair of widely spaced, relatively narrow claws embedded at widely spaced points on wide beads 50. This structural concept does not constitute, per se, an aspect of this invention but is described and claimed in referent U.S. Pat. No. 4,032,811.

Figure 3:
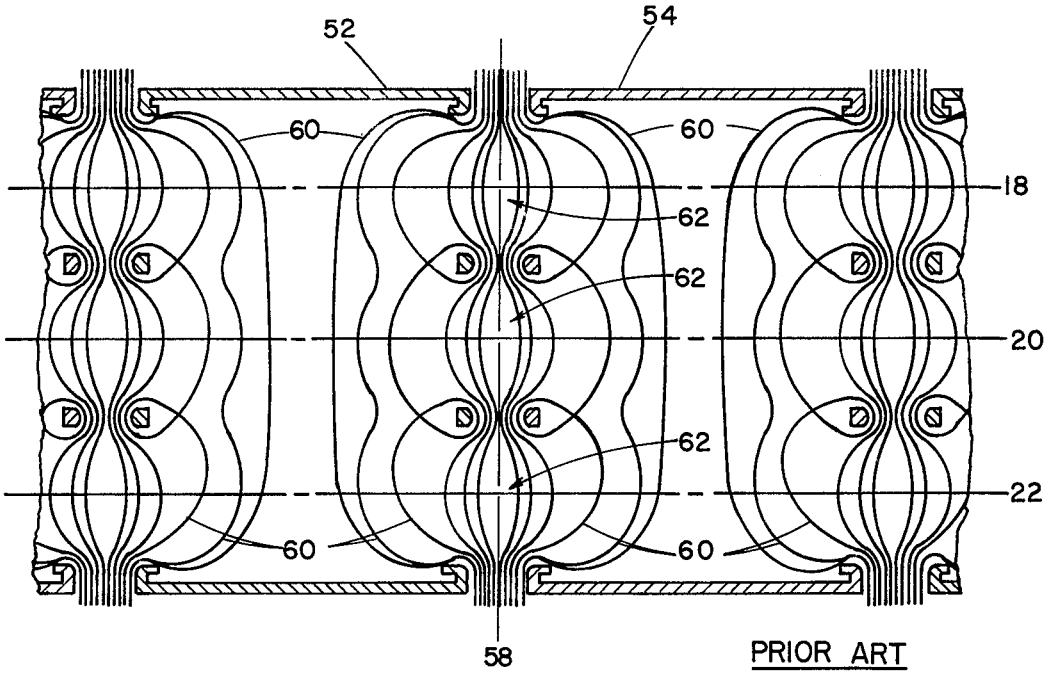
FIG. 3 is a sectional view in elevation of the interiors of axially aligned electrodes of a prior art gun showing schematically the undesired interaction of equipotential lines which occur within electrodes which do not provide shielding.

This disclosure describes, in the illustrated preferred embodiment of this invention, elongated electrodes for unitized electron guns which have within each electrode three effectively continuous, electrically shielding beam-passing tubes therethrough, and wherein the electrodes define electrically conductive enclosures around said tubes. The advantages of such an electrode structure is shown by comparison with a prior art structure shown by FIG. 3. Shown schematically are the inter- and intra-electrode paths of travel of three coplanar electron beams 18, 20 and 22. Two typical electrodes 52 and 54 are operated at different potentials to form an electron lens at their interfaces 58, as shown by the equipotential lines 60. The beam-passing apertures in this prior art example consist of holes 62 formed in the faces of the electrodes, with hole edges slightly extruded inwardly. The lines of force generated by the electron lens interact to distort the unshielded beams. The close-lying outer walls of electrodes 52 and 54 also distort the magnetic field by exerting an additional malforming effect on the two outer beams 18 and 22. The end-result of this undesired interference cannot be depicted schematically in FIG. 3 because the effect does not appear in this area. Rather, the effect appears on the television viewing screen in the form of larger spot size resulting in turn from a necessary correction of the beams for the ellipticity, or astigmatism, that is the consequence of the interaction. The larger spot size in turn appreciably reduces the potential picture resolution.

Figure 4:
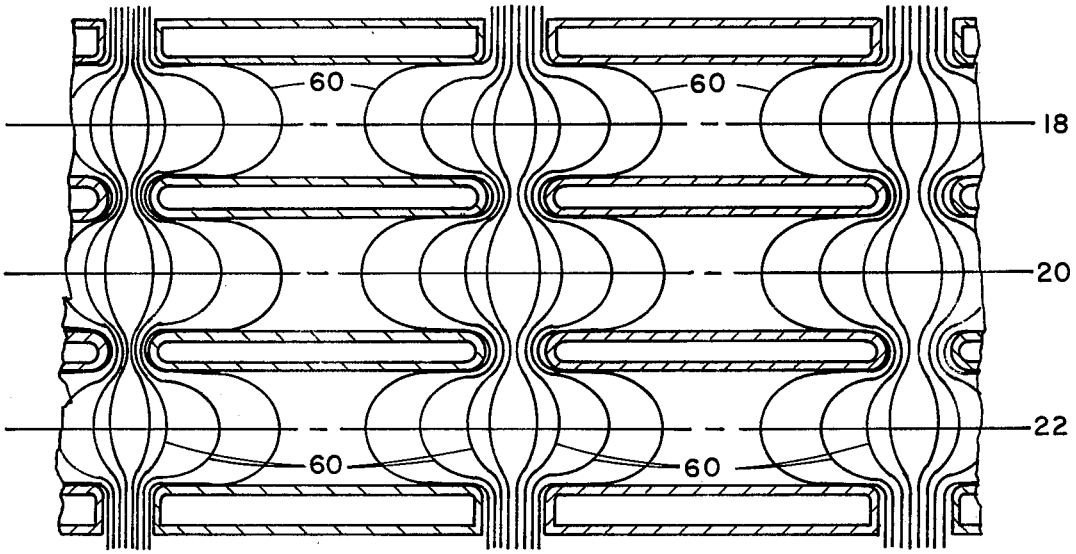
FIG. 4 is a sectional view in elevation of the interiors of typical axially aligned unitized electrodes constructed according to this invention; the Figure shows schematically the beneficial effect of shielding on the contours of the equipotential lines.

The result of the application of the invention is shown by FIG. 4, which is also an elevational schematic view of the inter- and intra-electrode paths of three coplanar beams 18, 20 and 22. In this embodiment, the electrodes are constructed so as to provide three continuous, electrically shielding, beam-passing tubes. The beneficial contouring effect on the equipotential lines 60 because of non-interference is shown by FIG. 4, and their symmetry is reflected in the maintenance of the relatively circular cross-section of the beams that pass through the magnetic field formed by this sector of the electron lens. The effect is to not ellipticize the beams and thus to enhance picture resolution.

Figure 5:
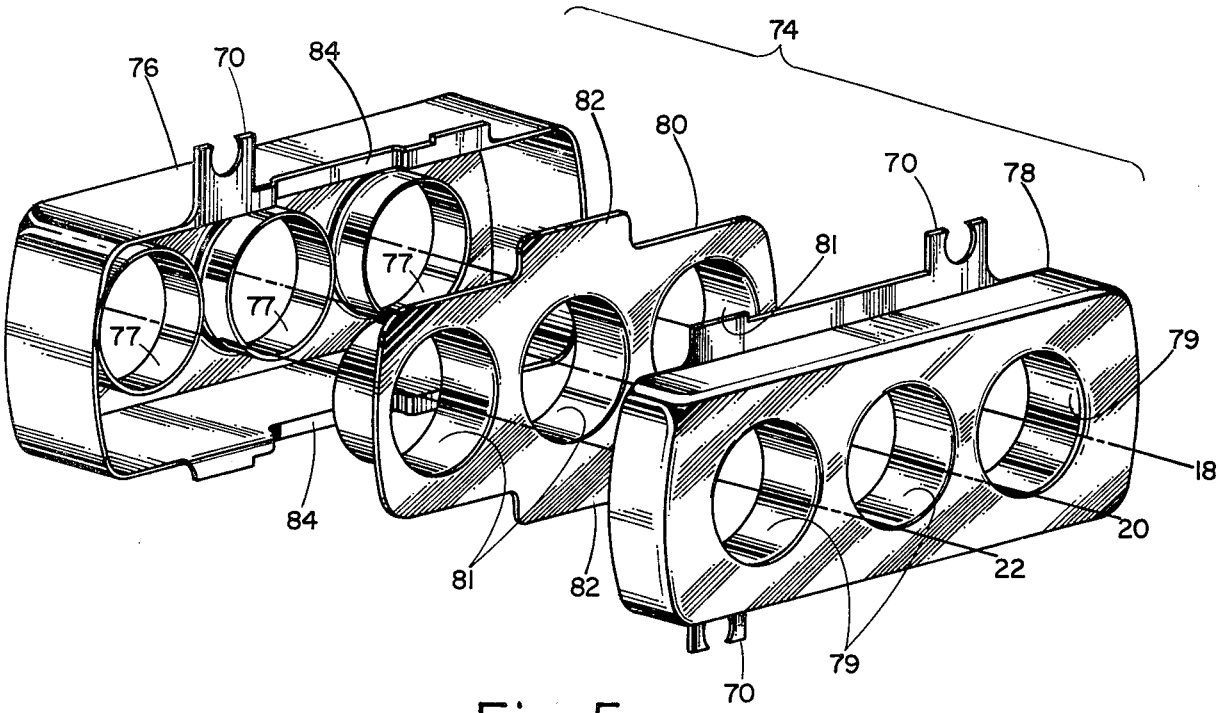
FIG. 5 is an exploded perspective view of an electrode embodying this invention and comprising one inside part and two outside parts.

An electrode 74, representing one aspect of the preferred embodiment of this invention is shown in exploded view in FIG. 5. Electrode 74 is comprised of two substantially similar cup-like outside parts 76 and 78, each of which is configured to have inwardly pointing annular lips 77 and 79 drawn integrally from the electrode material. Inside part 80 is similarly formed with annular lips 81. Inside part 80 serves to fill the hiatus that would otherwise exist between the inwardly pointing distal ends of lips 77 of outside part 76 and the inwardly pointing distal ends of lips 79 of outside part 78. The need for inside part 80 is dictated by the relatively longer axial length of electrode 74. It should be noted that there would be no problem fabricating electrodes which are axially shorter and having beam-passing tubes therethrough because the annular lips can be extruded sufficiently by the present state of metal-working art to make an insert unnecessary.

Inside part 80 fulfills another function which represents another aspect of this invention. Although outside parts 76 and 78 are inherently quite strong, their center sections are unsupported and can deflect and distort as a result of any inward pressure such as might be exerted upon electrode 74 during the beading process. However, inside part 80, which is welded to both outside parts 76 and 78, acts as an internal supportive member to prevent a deformation of electrode 74 under physical stress.

Figure 6:
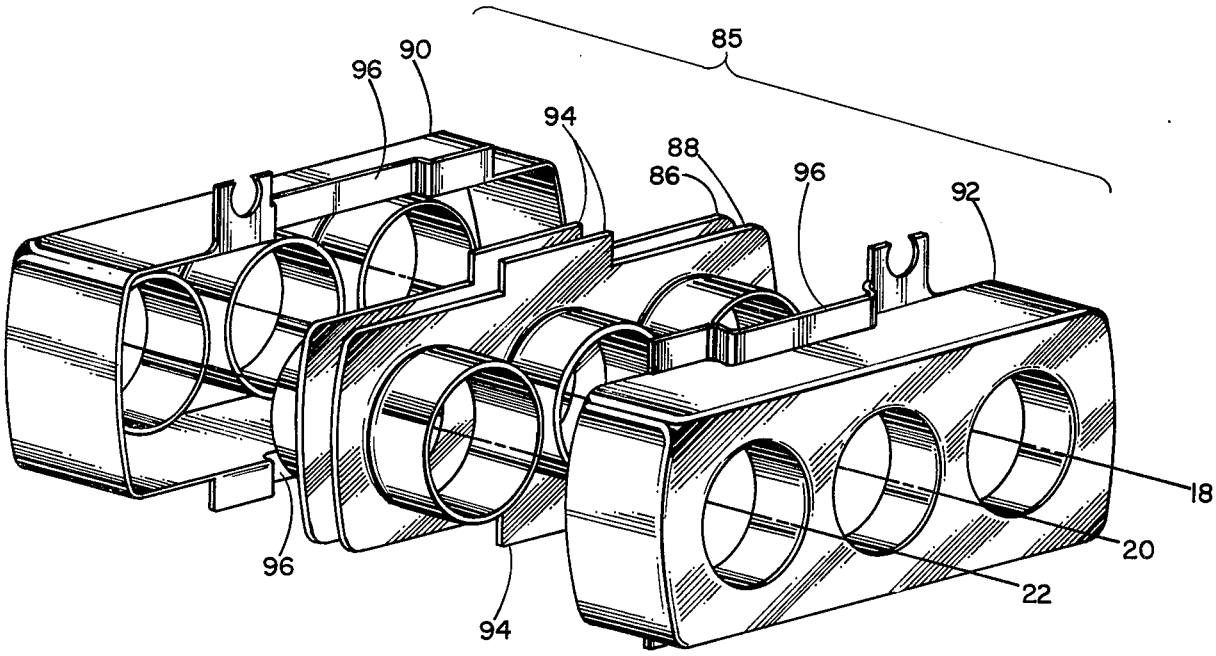
FIG. 6 is an exploded perspective view of another electrode embodying this invention, comprising two inside parts and two outside parts.
Figure 7:
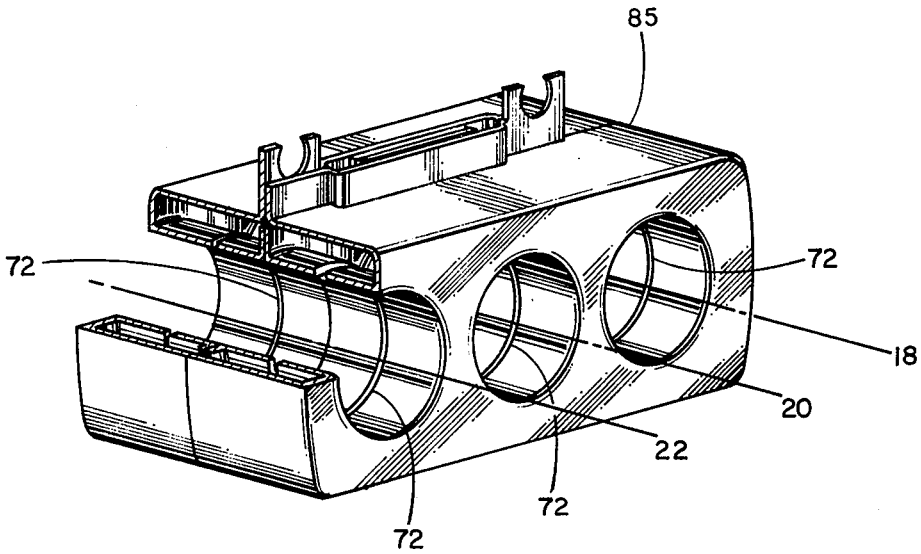
FIG. 7 is an assembled view of the FIG. 6 electrode, with the nearest end section cut away to show hidden internal details of the placement and alignment of the two inside parts with relation to the two outside parts.

Another embodiment of this invention is shown by FIG. 6, which discloses an electrode 85 having two inside parts 86 and 88. This two-inside-part electrode 85 is comprised of outside parts 90 and 92. Inside parts 86 and 88 are here shown as being formed identically, but are positioned with flat sides adjacent or back-to-back. The tabs 94 which project from inside parts 86 and 88 are located at the top and bottom of each inside part. When the entire assembly is brought together, that is, outside parts 90 and 92 with inside parts 86 and 88, the tabs 94 of inside parts 86 and 88 mate with the top and bottom recesses 96 located in outside parts 90 and 92. The beam-passing tubes are coaxially aligned by the insertion of positioning mandrels in the two outer beam-passing tubes for beams 18 and 22. The assembly is then permanently bonded into an integral unit by means such as welding. An assembled view of electrode 85 is shown by FIG. 7, in which the nearest end has a section cut away to show the details of the effectively continuous, electrically shielding beam-passing tubes, with each tube being formed by a contiguous axial succession of annular lips drawn from the sheet metal parts from which they extend.

The small gaps 72 between the opposing faces of the internal beam-passing tubes are formed purposely because if the tubes were extended to the point of contact in advance of the true electrode mating surfaces of the cup-like outside parts, the tube faces could meet and prevent proper contact of the electrode flanges for bonding. With regard to the influence of these gaps 72 on beam shielding, there is no effect as the electrostatic field "sees" an effectively continuous beam-passing tube because of the smallness of the gap. The design target dimensional width of the gap is 0.010 inch (0.250 mm).

Figure 8:
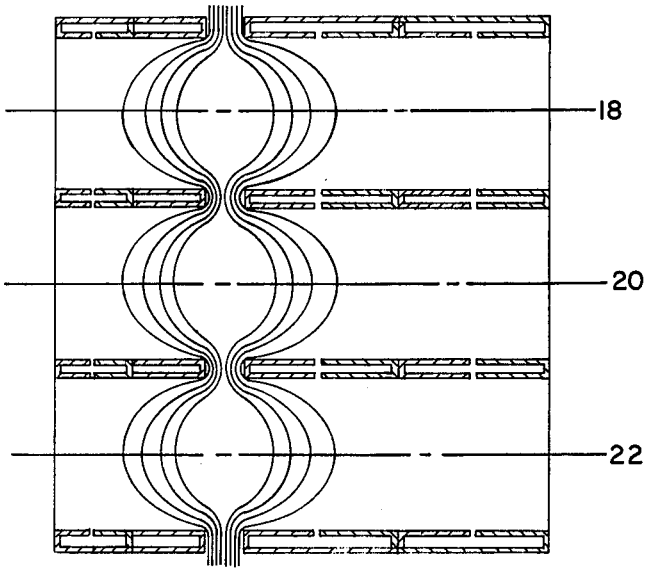
FIG. 8 is a sectional view in elevation of the interior of two axially aligned unitized electrodes constructed according to this invention; shown schematically are the beneficial effects of beam shielding on the contours of the equipotential lines due to the lack of interference.

FIG. 8 is a sectional view in elevation of two contiguous axially oriented electrode structures fabricated according to this invention, with the equipotential lines resulting from different potentials applied thereto shown schematically. The beneficial effect on the contours of equipotential lines resulting from lack of interference (as contrasted with FIG. 3), illustrates the advantages of unitized electrodes having effectively continuous, electrically shielding beam-passing tubes.

The exemplary dimensions of electrode 85, as described and shown by FIGS. 6 and 7, and excluding claws, are as follows: width is 0.870 inch (22.098 mm); height is 0.494 inch (12.548 mm); length (in a direction of the beam axis) is 0.500 inch (12.70 mm); and the length of the annular lips of the two inside parts 86 and 88 is 0.135 inch (3.43 mm). Tube inside diameters are 0.226 inch (5.74 mm).

Figure 9:
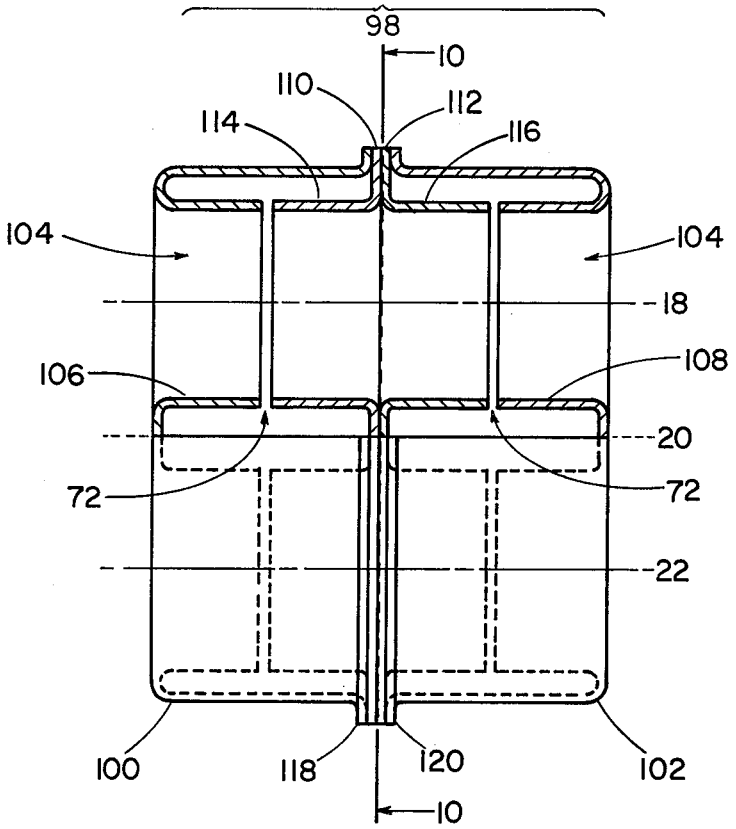
FIG. 9 is a schematic side view partially in section of a delta-configured gun electrode having effectively continuous beam-passing tubes formed with two inside parts.
Figure 10:
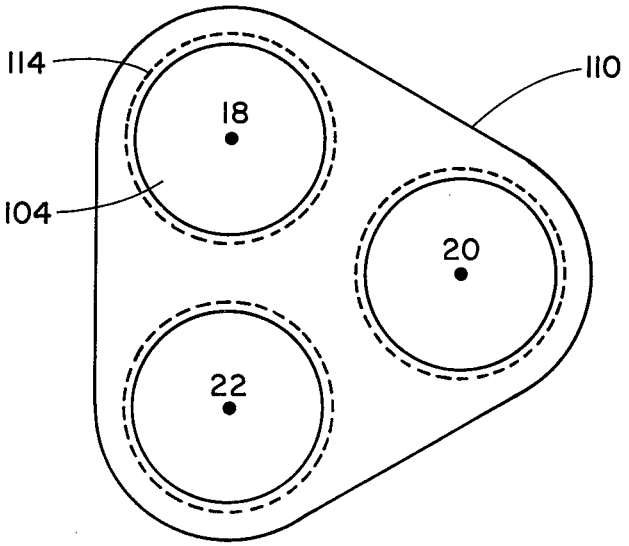
FIG. 10 is a sectional view of an inside part for a delta-configured gun taken along lines 10—10 of FIG. 9.

FIGS. 9 and 10 show an embodiment of the invention as applied to unitized, delta-configured electron guns for color cathode ray tubes. FIG. 9 is a schematic side view partially in section of a delta-configured electrode assembly. FIG. 10 is a sectional view of inside part 110 taken along lines 10—10 of FIG. 9. The outer structure of electrode assembly 98 is formed from two cup-like outside parts 100 and 102. Electrode assembly 98 has three beam-passing apertures therethrough for the passage of electron beams 18, 20 and 22. With reference to the sectioned view of FIG. 9, beam-passing aperture 104 of outside parts 100 and 102 is formed with inwardly pointing annular lips 106 and 108 which are in turn formed from the sheet metal of each outside part 100 and 102, using a deep-drawing process. The resulting hiatus between inwardly pointing lip 106 of outside part 100 and the inwardly pointing lip 108 of outside part 102 is filled by inside parts 110 and 112. Inside parts 110 and 112 are identical, and are formed with deep-drawn annular lips 114 and 116, respectively, and are dimensioned so that they can be positioned in precise alignment with corresponding annular lips 106 and 108 of outside parts 100 and 102.

Assembly of electrode 98 is accomplished by positioning inside parts in proper relation to and outside parts; for example, inside part 110 in relation to outside part 100 so that the outwardly pointing lip 114 of inside part 110 is contiguous to inwardly pointing lip 106 of outside part 100. The beam-passing apertures 18, 20 and 22 are then coaxially aligned by locating mandrels and the two parts is permanently bonded by means such as welding. Inside part 112 and outside part 102 are similarly mated and bonded. Inside parts 110 and 112, attached to outside parts 100 and 102 respectively, are positioned back-to-back and the beam-passing apertures 18, 20 and 22 are aligned by locating mandrels. Electrode 98 is then permanently bonded by means such as spot-welding applied through flanges 118 and 120. The resulting electrode comprises three effectively continuous, electrically shielding beam-passing tubes, with each tube formed by a contiguous axial succession of annular lips drawn integrally from the sheet metal parts.

Inside parts 110 and 112 serve another function by the fact that they are internal and intermediately located between the ends of outside parts 100 and 102. The deep-drawn cup-like structure of outside parts 100 and 102 leaves their center sections unsupported and subject to inward pressure such as might result from the beading process, resulting in possible deformation of the electrode. Inside parts 110 and 112, which are bonded permanently to outside parts 100 and 102 as described, act as internal supportive members to prevent the distortion of electrode 98 when under physical pressure.

The gaps 72, as described earlier in this disclosure, are necessary to the assembly process. Because of the smallness of the gaps, there is no effect on the beam as the electrostatic field "sees" an effectively continuous beam-passing tube.

With regard to the mode of fabricating the electrodes, the process of die-forming was selected for its economies of manufacture along with the ability of the process to form parts meeting close-tolerance requirements. In the embodiments of this invention, stainless steel was selected because it lends itself well to this type of application, having excellent corrosion resistance, high strength, tolerance to high temperature; also, stainless steel of the type used is essentially non-magnetic and does not harden by heat treatment. The stainless steel for this application is preferably of the austenitic family, AISI type 305.

The primary problem in die-forming the electrodes resulted from the close proximity of the inwardly extending annular lips one to the other. For example, with regard to the closure side-by-side contiguity of the annular lip sections 77, 79 and 81 of electrode 74 as shown in FIG. 5, the actual center-line-to-center-line distance of any two adjacent lip apertures is 0.270 inch (6.86 mm). By subtracting the two radii of two adjacent apertures, and by factoring in the wall thickness of each tube, the distance between any two adjacent tubes as measured between the outer walls is normally 0.030 inch (0.762 mm). The main problem in deep extruding closely adjacent tubular sections is that of "finding" adequate material to extend the extrusions to the desired depth. This was accomplished by utilizing the material itself by "ironing" the material under very high pressure. For example, the thickness of the sheets used to form the electrodes is nominally 0.015 inch (0.381 mm). By using tungsten carbide dies, material thickness was reduced to approximately 0.008 inch (0.203 mm) by means of very high pressure exerted on the metal between the drawing die and the punch, thereby ironing the material into the unusual length of extrusion that was obtained. The objectives of this invention are realized by using the described technique to form extruded lips whose lengths fall in the range of four-tenths to six-tenths of the inside diameters of the beam-passing tubes. The very high pressure offers another advantage that it creates a smooth surface on the inner surface of the beam-passing tubes.

Other changes may be made in the above-described apparatus without departing from the true spirit and scope of the invention herein involved, and it is intended that the subject matter in the above depiction shall be interpreted as illustrative and not in a limiting sense.

We claim:

1. A relatively axially long unitized electron gun electrode comprising a combination of two outside sheet metal parts and two inside sheet metal parts, said combination being axially arranged and conjoined to define three effectively continuous, electrically shielding beam-passing tubes extending completely through the electrode, each tube being formed by a contiguous axial succession of deep-drawn annular lips drawn integrally from said inside and outside sheet metal parts, wherein said lips on said outside parts are deep-drawn inwardly toward each other, wherein said lips on said inside sheet metal parts are also deep-drawn, wherein said inside parts are located intermediately between the ends of said two outside parts to act as internal supportive members to resist deformation of said electrode when said electrode is physically stressed, and wherein said inside parts have lips that point outwardly, said lips on said inside parts being spaced from said lips on said outside parts by small gaps.

2. The electrode defined by claim 1 wherein said outside parts have integral, radially extending flanges, and wherein said inside parts have a plurality of radially projecting support tabs which are captured by an equivalent plurality of recesses in the flange on at least one of said outside parts.

* * * * *